US008910660B2

(12) United States Patent
Schmidt et al.

(10) Patent No.: US 8,910,660 B2
(45) Date of Patent: Dec. 16, 2014

(54) VALVE ARRANGEMENT

(75) Inventors: Matthias Schmidt, Frankfurt (DE); Franz-Josef Körber, Altenstadt (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/475,442

(22) Filed: May 18, 2012

(65) Prior Publication Data

US 2012/0280152 A1 Nov. 8, 2012

Related U.S. Application Data

(63) Continuation of application No. PCT/EP2010/066043, filed on Oct. 25, 2010.

(30) Foreign Application Priority Data

Nov. 20, 2009 (DE) ..... 10 2009 053 901

(51) Int. Cl.
*F15B 20/00* (2006.01)
*F15B 11/00* (2006.01)

(52) U.S. Cl.
CPC ..... *F15B 11/006* (2013.01); *F15B 2211/355* (2013.01); *F15B 2211/329* (2013.01); *F15B 2211/30575* (2013.01)
USPC ..... 137/596.16; 137/596.14

(58) Field of Classification Search
USPC ..... 137/596, 596.14, 596.15, 596.16; 251/65
See application file for complete search history.

(56) References Cited

U.S. PATENT DOCUMENTS 3,213,334 A 10/1965 Forwald
4,066,103 A * 1/1978 Tandrup ..... 137/625.64
4,082,111 A * 4/1978 Budzich ..... 137/596
(Continued)

FOREIGN PATENT DOCUMENTS

DE 2 047 838 A1 3/1972
DE 2 047 847 A1 3/1972
DE 201 16 920 U1 1/2002
JP 8-91742 A 4/1996

OTHER PUBLICATIONS

International Search Report (PCT/ISA/210) issued on Jan. 31, 2011, by the European Patent Office as the International Searching Authority for International Application No. PCT/EP2010/066043.

*Primary Examiner* — Craig Schneider
*Assistant Examiner* — Umashankar Venkatesan
(74) *Attorney, Agent, or Firm* — Buchanan Ingersoll & Rooney PC

(57) ABSTRACT

Exemplary embodiments are direct to a valve system for actuating the piston of a piston cylinder arrangement for a hydraulic or fluid device, and for actuating the piston cylinder arrangement for actuating the movable contact piece of a high-voltage circuit breaker. The system including a main control valve arrangement, having two 2/2-way valves used as main valves and which can be controlled by a pilot control valve arrangement. The main control valve arrangement directs a path for the high pressure fluid to the chamber above the piston and connects the chamber to a low-pressure tank for discharging the chamber above the piston. Two 2/2-way valves which form the pilot control valve arrangement are associated with the main control valve arrangement such that the 2/2-way valves direct or supply either a high-pressure control pressure or a low-pressure control pressure to the main control valve arrangement.

14 Claims, 5 Drawing Sheets

(56) References Cited

U.S. PATENT DOCUMENTS

| | | | | | |
|---|---|---|---|---|---|
| 4,557,180 | A | * | 12/1985 | Glomeau | 91/446 |
| 4,835,970 | A | * | 6/1989 | Shimamura et al. | 60/545 |
| 5,184,535 | A | * | 2/1993 | Kimura | 91/443 |
| 5,273,069 | A | * | 12/1993 | Akiyama et al. | 137/596 |
| 5,440,967 | A | * | 8/1995 | Wennerbo | 91/471 |
| 6,450,478 | B2 | * | 9/2002 | Parsons et al. | 251/129.04 |
| 6,761,186 | B2 | * | 7/2004 | Heusser et al. | 137/625.66 |
| 2003/0079785 | A1 | | 5/2003 | Heusser et al. | |

* cited by examiner

VALVE ARRANGEMENT

RELATED APPLICATIONS

This application claims priority as a continuation application under 35 U.S.C. §120 to PCT/EP2010/066043, which was filed as an International Application on Oct. 25, 2010 designating the U.S., and which claims priority to German Application 102009053901.8 filed in Germany on Nov. 20, 2009. The entire contents of these applications are hereby incorporated by reference in their entireties.

FIELD

The present disclosure relates to a valve, such as a valve arrangement or valve system for actuating a piston of a piston/cylinder arrangement for a hydraulic or fluidic device.

BACKGROUND INFORMATION

A generic valve arrangement is known from DE 201 16 920 U1. Valve arrangements of this type are used to activate piston/cylinder arrangements in which, within a cylinder space, a piston is located, to one side face of which is connected one end of a piston rod which is extendable out of the cylinder space and is retractable into this. The space beneath the piston is located on that side of the piston which the piston rod adjoins, whereas the space above the piston is arranged on the other side of the piston. As a result, the cross-sectional area of the space above the piston is greater than the cross-sectional area below the piston, because, in the case of the latter, the cross-sectional area of the piston rod is subtracted. When high-pressure fluid is supplied to the spaces above and below the piston, the piston moves in the direction of the extension of the piston rod; when the space above the piston is relieved in that this space and the fluid located in it are connected to a reservoir which is at low pressure, also called a low-pressure tank, the piston moves in the opposite direction on account of the high pressure in the space below the piston, so that the piston rod is retracted.

By means of this piston/cylinder arrangement, for example, the movable contact pieces of a high-voltage circuit breaker can be actuated.

Of course, by means of such a piston/cylinder arrangement, other components can also be moved, such as, for example, crane arms, buckets or bucket excavators, and the like.

In many applications, for example, a changeover is to take place without reversal losses, that is to say when a volume flow from the pressure connection via the two control edges to the low-pressure tank is to be avoided during the switching operation, so that a different flow resistance or volume flow, depending on the switching position, a short switching time or actuation by means of a low pilot control volume can be achieved.

However, when a 3/2-way valve is used, these specifications often can be fulfilled only inadequately or at a high outlay in production terms and with high production costs. If two 2/2-way valves are used as main control valves, in the event of a changeover the open valve first has to be closed before the closed valve is opened, if a reversal loss is to be avoided and if no further measures are taken. However, for this purpose, in the case of pilot-controlled valves, at least two pilot control valves with suitable activation electrics, for example with time-delayed or sensor-controlled triggering of the second valve, should be used. This entails further high costs and an unnecessarily long delay in the opening of the second 2/2-way valve after the closing of the first.

SUMMARY

An exemplary valve arrangement for actuating a piston of a piston/cylinder arrangement for a hydraulic or fluidic device, and for actuating the piston/cylinder arrangement for actuating of a movable contact piece of a high-voltage circuit breaker is disclosed. The valve arrangement comprising: a main control valve arrangement including two 2/2-way valves which are activatable by a pilot control valve arrangement and provides a way for the fluid, which is under high pressure, to flow into a space above the piston and connects the space to a low-pressure tank for relieving pressure in the space, wherein the 2/2-way valves are connected to a pilot control valve arrangement, such that the 2/2-way valves feed or deliver fluid to the main control valve arrangement at either a high pressure or a low pressure, wherein when the fluid, which is under high pressure, is supplied to the space above the piston, a first pilot control valve of the pilot control valve arrangement opens a path for the fluid which is under high pressure to flow into a main control face of a first main control valve of the main control valve arrangement, so that the first main control valve feeds the fluid which is at high pressure to the space above the piston and a second pilot control valve of the pilot control valve arrangement is closed, and wherein when pressure is relieved in the space above the piston, the second pilot control valve opens a path from a main control face of a second main control valve of the main control valve arrangement to the low-pressure tank and the second main control valve opens a path from the space above the piston to the low-pressure tank.

A valve arrangement for actuating a piston of a piston/cylinder arrangement for a hydraulic or fluidic device is disclosed, comprising: a main control valve arrangement including two 2/2-way valves which are activatable by a pilot control valve arrangement and provides a way for the fluid, which is under high pressure, to flow into a space above the piston and connects the space to a low-pressure tank for relieving pressure in the space; and a pilot control valve arrangement having first and second pilot control valves that are connected to the two 2/2 way valves, respectively, of the main control valve arrangement, wherein when high pressure fluid is supplied to the space above the piston, the first pilot control valve opens a path for the high pressure fluid to flow into a first main control valve of the main control valve arrangement, so that the first main control valve feeds the high pressure fluid to the space above the piston, and wherein when pressure is relieved in the space above the piston, the second pilot control valve opens a path from a second main control valve of the main control valve arrangement to the low-pressure tank and the second main control valve opens a path from the space above the piston to the low-pressure tank.

A valve arrangement for actuating the piston/cylinder arrangement for actuating of a movable contact piece of a high-voltage circuit breaker is disclosed, comprising: a main control valve arrangement including two 2/2-way valves which are activatable by a pilot control valve arrangement and provides a way for the fluid, which is under high pressure, to flow into a space above the piston and connects the space to a low-pressure tank for relieving pressure in the space; and a pilot control valve arrangement having first and second pilot control valves that are connected to the two 2/2 way valves, respectively, of the main control valve arrangement, wherein when high pressure fluid is supplied to the space above the piston, the first pilot control valve opens a path for the high pressure fluid to flow into a first main control valve of the main control valve arrangement, so that the first main control valve feeds the high pressure fluid to the space above the piston, and wherein when pressure is relieved in the space above the piston, the second pilot control valve opens a path from a second main control valve of the main control valve arrangement to the low-pressure tank and the second main control valve opens a path from the space above the piston to the low-pressure tank.

BRIEF DESCRIPTION OF THE DRAWINGS

The disclosure and also further advantageous refinements and improvements and further advantages will be explained in more detail and described by means of the drawing which illustrates two exemplary embodiments of the disclosure and in which.

DETAILED DESCRIPTION

Exemplary embodiments of the present disclosure improve further and to simplify a valve arrangement of the type initially mentioned.

The advantages can be achieved by the exemplary embodiments disclosed herein, in particular, that, by means of a valve arrangement composed of two commercially available pilot control valves and of two correspondingly designed 2/2-way valves as main valves or main control valves, the specifications stated above, such as, for example, changeover without reversal losses, a different flow resistance or volume flow depending on the switching position, a very short switching time and actuation by means of a low pilot control volume, can be fulfilled in spite of a comparatively low outlay in production terms.

In this case, according to an exemplary embodiment, the valve arrangement is characterized in that, to supply the high-pressure fluid into the space above the piston, the first pilot control valve opens the way for the fluid which is at high pressure to the main control face of the first main valve, so that the latter feeds the fluid which is at high pressure to the space above the piston, the second pilot control valve being closed, and in that, to relieve the space above the piston, the second pilot control valve opens the way from the main control face of the second main control valve to the low-pressure tank and consequently the second main control valve opens the way from the space above the piston to the low-pressure tank.

A further advantageous embodiment of an exemplary valve arrangement may be that a orifice having a small cross section is provided between the main control faces of the main control valves and the space above the piston of the piston/cylinder arrangement.

This orifice is important inasmuch as, in the event of leakage of, for example, the pilot control valves, it can maintain the high pressure or even the low pressure upstream of the piston/cylinder arrangement, so that faulty movement of the piston in the event of an undesirable lowering of the high pressure or an undesirable rise in the low pressure due to leakage is prevented.

According to the exemplary embodiments disclosed herein the piston of the first main control valve, designed as a bistable valve, is retained in its end positions. In a first embodiment, this is achieved in that the piston is retained mechanically by means of a spring-assisted ball latching. In a further refinement, the piston can be retained in its end positions mechanically and magnetically. In this case, the piston can move in a cylinder, a permanent magnet being provided at one end of the cylinder and a spring being provided between this end and the piston, and the force acting upon the piston having a zero crossing.

Figure 1:
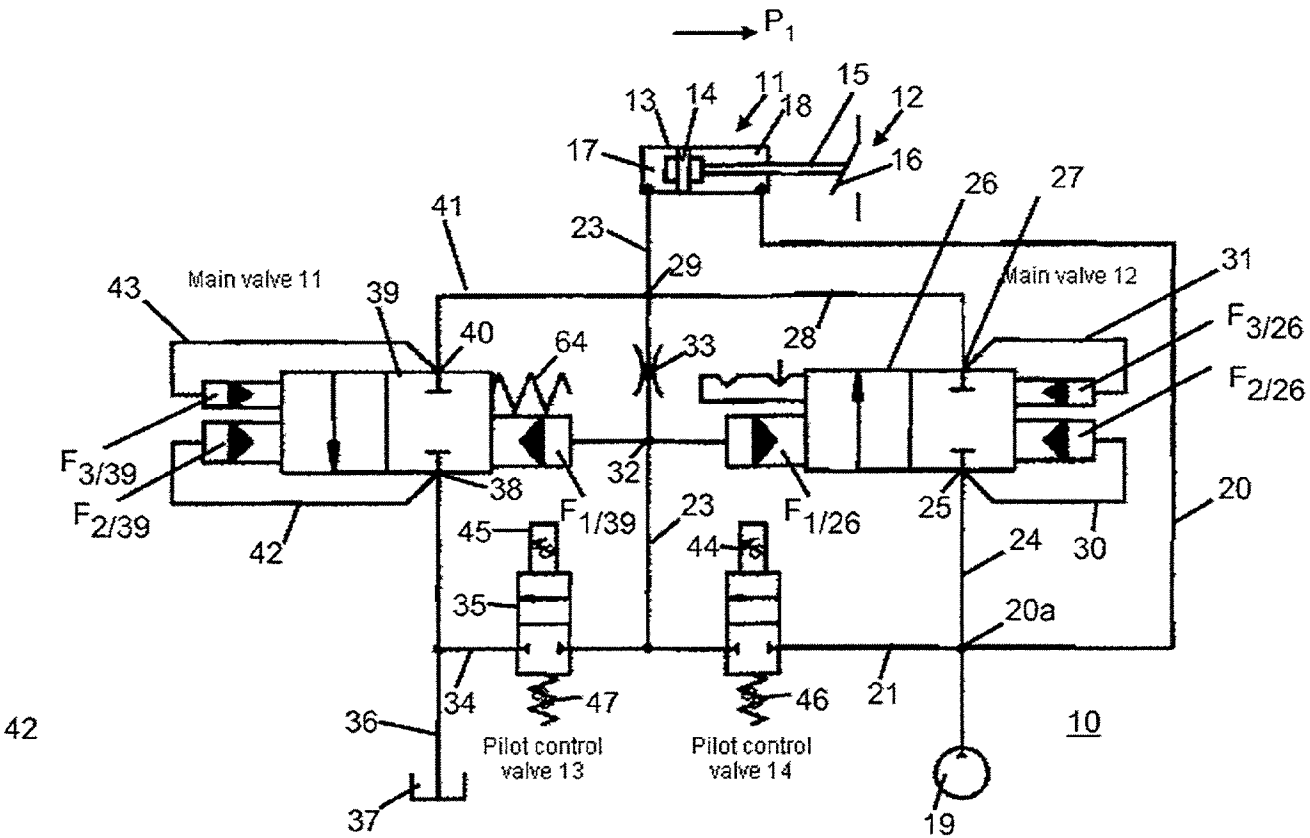
FIG. 1 shows a circuit arrangement of a valve system in accordance with an exemplary embodiment of the present disclosure.

FIG. 1 shows a circuit arrangement of a valve system in accordance with an exemplary embodiment of the present disclosure. FIG. 1 illustrate a valve arrangement 10 serving for activating a piston/cylinder arrangement 11, by means of which an electrical high-voltage circuit breaker 12 can be actuated. The piston/cylinder arrangement 11 includes a cylinder 13 in which is movable a piston 14, to one side of which is connected a piston rod 15 which is connected to a movable contact piece 16 of the high-voltage circuit breaker 12. The piston 14 subdivides the cylinder inner space into a space 17 above and a space 18 below the piston 14, the latter space receiving the piston rod 15. Since the piston rod 15 adjoins the piston face which delimits the space 18 below the piston 14 and consequently reduces the piston face by the amount of the cross section of the piston rod 15, the piston face which delimits the space 17 above the piston 14 is greater than the piston face confronting the space 18 below the piston 14.

To drive the piston 14 so that the latter is extended, hydraulic fluid is supplied by means of a pump or in another way from a high-pressure reservoir 19, depending on the position of the valve arrangement, to the space 17 above the piston 14 and to the space 18 below the piston 14, as follows, this being an operation to switch on the circuit breaker.

The high-pressure reservoir 19 has adjoining it a first line section or line length 20 which connects the high-pressure reservoir 19 to the space 18 below the piston 14. The first line section 20 has adjoining it a second line section 21 which is connected to a first pilot control valve 22. The pilot control valve 22 is connected to a third line section 23 which issues into the space 17 above the piston 14 and connects the first pilot control valve 22 to the space 17 above the piston 14. The first line section 20 and there, in particular, the junction point between the first and the second line section 20, 21 have adjoining them a fourth line section 24 which is connected to the first port, also called below the inlet port 25 of a first main control valve 26. The second port, also called below the outlet port 27 of the first main control valve 26, has adjoining it a fifth line section 28 which is connected to the third line section 23 at a junction point 29. On the first main control valve 26, a first return 30 is provided, which adjoins the inlet port 25 and which is connected to a second control face $F_2$/26. Furthermore, a third control face $F_3$/26 is provided, which is connected to the outlet port 27 via a second return 31.

The first main control valve 26 includes a first control face $F_1$/26 which is dimensioned such that the following relation applies:

$$F_1/26=F_2/26+F_3/26.$$

The first control face $F_1$/26 is connected to the third line section 23 via a second junction point 32. Between the first junction point 29 and the second junction point 23 is located a orifice 33 having a small cross section, see also further below.

Connected to the third line section 23 is a sixth line section 34 in which a second pilot control valve 35 is located.

The sixth line section 34 is connected to a seventh line section 36 which issues, on the one hand, into a low-pressure tank 37 and, on the other hand, into a first port, also called below the inlet port 38 of a second main control valve 39. The second port, also called below the outlet port 40 of the second main control valve 39, is connected to the first junction point 29 via an eighth line section 36*a*.

A first control face $F_1$/39 of the second main valve 39 is connected to the second junction point 32; the second main control valve 29 includes in each case a second and a third control face $F_2$/39 and $F_3$/39 corresponding to the control faces $F_2$/26 and $F_3$/26, here, too, the rule: $F_1/39=F_2/39+F_3/39$ applying, the pressures acting upon the control faces $F_1$/39 and $F_2/39+F_3/39$ acting in the opposite direction upon the piston (see further below) of the main control valve 39. As in the case of the first main control valve 26, the inlet port 38 of the second main control valve 39 is connected to a first return 42 and to the second control face $F_2$/39, and the outlet port 40 of the second main control valve 39 is connected to the third control face $F_3$/39 via a return 43.

The pilot control valves 22, 35 are driven electromagnetically and are brought out of the blocking position shown in FIG. 1 into the passage position by means of an electromagnetic system 44 or 45; in each case a restoring spring 46 and 47 replaces the pilot control valves 22 and 35 in the blocking position.

The valve arrangement 10, then, operates as follows:

FIG. 1 shows the circuit breaker 12 in the switch-off position. When the circuit breaker 12 is to be switched on, the first pilot control valve 22 is briefly brought into the opening position. High pressure thereby arrives via the line length 23 at the first control face $F_1$/26, with the result that the first main valve 26 is opened and the line length 24 is connected to the line length 28, so that the high-pressure fluid is conveyed into the space 17 above the piston 14. On account of the different piston faces, a force is generated which moves the piston 14 and consequently the piston rod 15 in the direction of the arrow P1, with the result that the movable contact piece 16 is brought into the switch-on position. Since the first main control valve 26 is a bistable 2/2-way valve, as will be explained in more detail further below, the first main control valve 26 remains in the passage position. The hydraulic forces upon the piston 14 are in this case zero on account of the above formula. The control face $F_1$/39 of the second main control valve 39 is also acted upon with high pressure via the junction point 32, so that the second main control valve 39 remains in the closing position.

The pilot control valve 22 then returns to the blocking position on account of the restoring spring 46. The region between the first main control valve 26 and, via the line length 41, also between the second main control valve 39 and the piston/cylinder arrangement 11 is consequently at high pressure.

In a switch-off action, the valve arrangement 10 operates as follows:

When the movable contact piece 16 is to assume the opening position, the space 17 above the piston 14 must be relieved. This takes place in that the second pilot control valve 35 is reversed to passage, with the result that low pressure prevails in the line length 23 between the second pilot control valve 35 and the orifice 33, so that low pressure likewise prevails at the first control face $F_1$/26 of the first main valve 26. As a result, the first main control valve 26 (it may be added here that "main control valve" and "main valve" are the same) is reversed back to the blocking position again on account of the force generated on the piston of the first main valve 26 by the control forces $F_2$/26 and $F_3$/26. Furthermore, low pressure prevails at the first control face $F_1$/39, so that the second main valve 39 is reversed to passage, because, although low pressure prevails at the second control face $F_2$/39, high pressure nevertheless acts at the third control face $F_3$/39 on account of the return 43. As a result, the piston (see further below) of the second main control valve 39 moves into the passage position, so that the space 17 above the piston 14 is relieved via the second main control valve 39. As a consequence of this, owing to the high pressure located in the space 18 below the piston, the piston 14 and consequently the piston rod 15 move in an arrow direction which is opposite to the direction of the arrow $P_1$. A switch-off of the circuit breaker 12 is thereby brought about.

Figure 2:
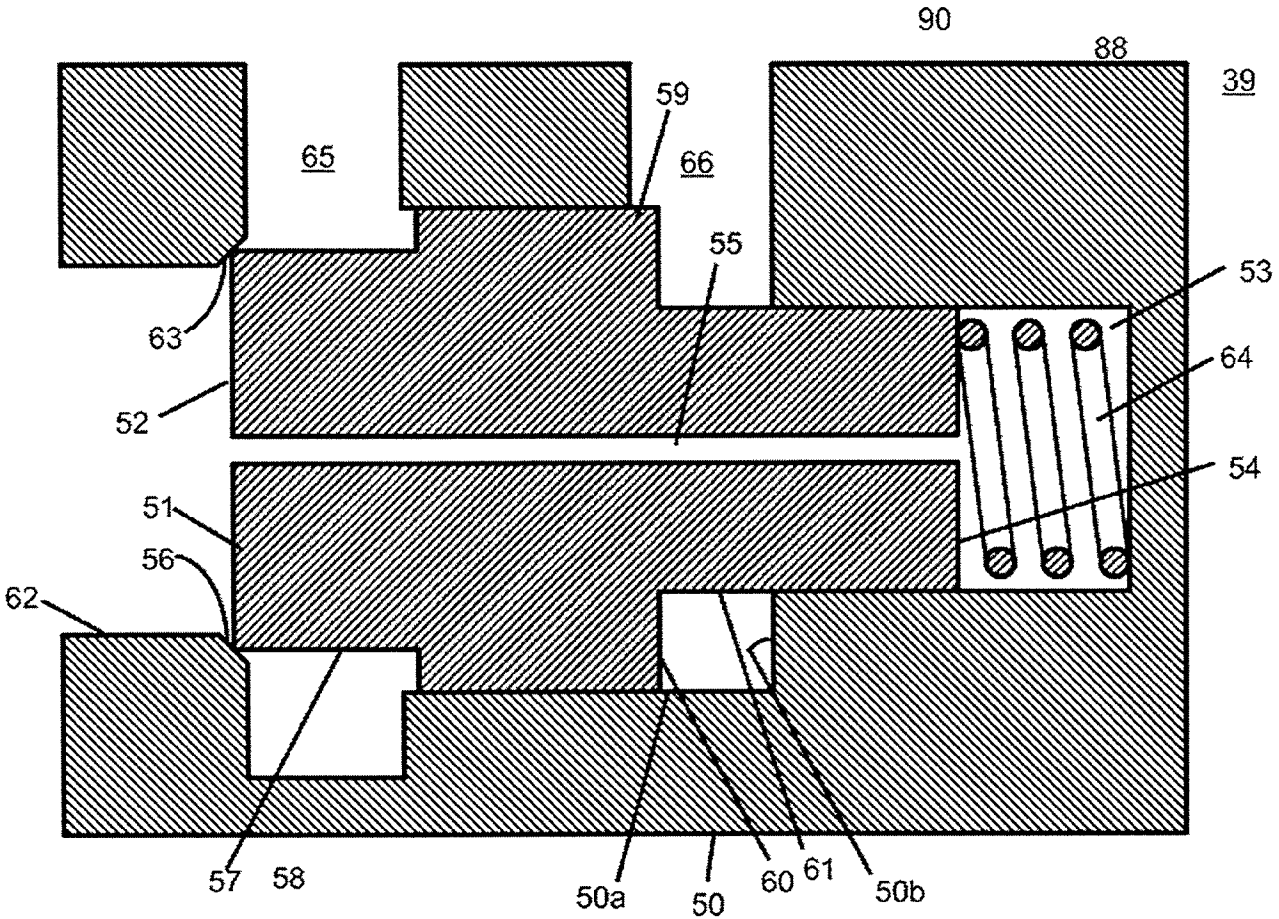
FIG. 2 shows a diagrammatic illustration of the second main valve in accordance with an exemplary embodiment of the present disclosure.

FIG. 2 shows a diagrammatic illustration of the second main valve in accordance with an exemplary embodiment of the present disclosure. The second main valve 39, as illustrated diagrammatically in FIG. 2, includes a cylinder body 50, also called in brief a cylinder 50, in which a piston 51 is movable back and forth, the piston 51 having a free face 52 which is connected to the low-pressure tank 37 and is consequently not acted upon by the high pressure. An inner duct 55 issues into the inner face 54 lying opposite the free face 52 and engaging into a depression 53 of the cylinder 50, the other end of said inner duct issuing into the free face 52, so that the low pressure which prevails at the free face 52 acts upon the inner face 54, also called briefly the inside face 54, so that the inner face 54 is connected to the tank 37. The free face 52 merges via a sealing edge 56 into a first piston section 57 which has adjoining it a step 58, via which the first piston section 57 is connected to a second piston section 59, the outside diameter of which is larger than the outside diameter of the first piston section 57. The second piston section 59 merges via a further step 60 into a third piston section 61 which engages into the depression 53, the outside diameter of which is smaller than the outside diameter of the piston section 57, the inner face 54 adjoining said third piston section.

In the region of the free face 52, the cylinder body 50 includes a first cylinder section 62, the inside diameter of which is smaller than the outside diameter of the first piston section 57, the inner end of the first cylinder section 62 having a chamfer 63 which opens at an angle of about 45 degrees into the interior of the cylinder 50, so that this chamfer 63 serves as a sealing seat for the sealing edge 56. Provided on the cylinder body 50 is a second cylinder section 50*a*, the inside diameter of which corresponds to the outside diameter of the second piston section 59, so that the second piston section 59 is movable slidably in the second cylinder section 50*a*. This second cylinder section 50*a* has adjoining it a step 50*b* which runs radially and via which the second cylinder section 50*a* merges into the depression 53.

The two faces 52 and 54 form as a whole the second control face $F_2$/39, whereas the step 58 forms the control face $F_3$/39. The step 60 then corresponds to the first control face $F_1$/39.

The piston 51 is under the pressure of a spiral compression spring 64 which is located in the depression 53 between the inner face 54 and the bottom of the depression 53.

Located in the cylinder body 50 are two holes 65 and 66, of which the hole 65 corresponds to the outlet port 40, whereas the free face 52 is assigned to the inlet port 38. The depicted position of the second main control valve 39 corresponds to the position in which the relief to the tank 37 is concluded.

The hole 66 issues with a generatrix into the step 50*b*.

Figure 3:
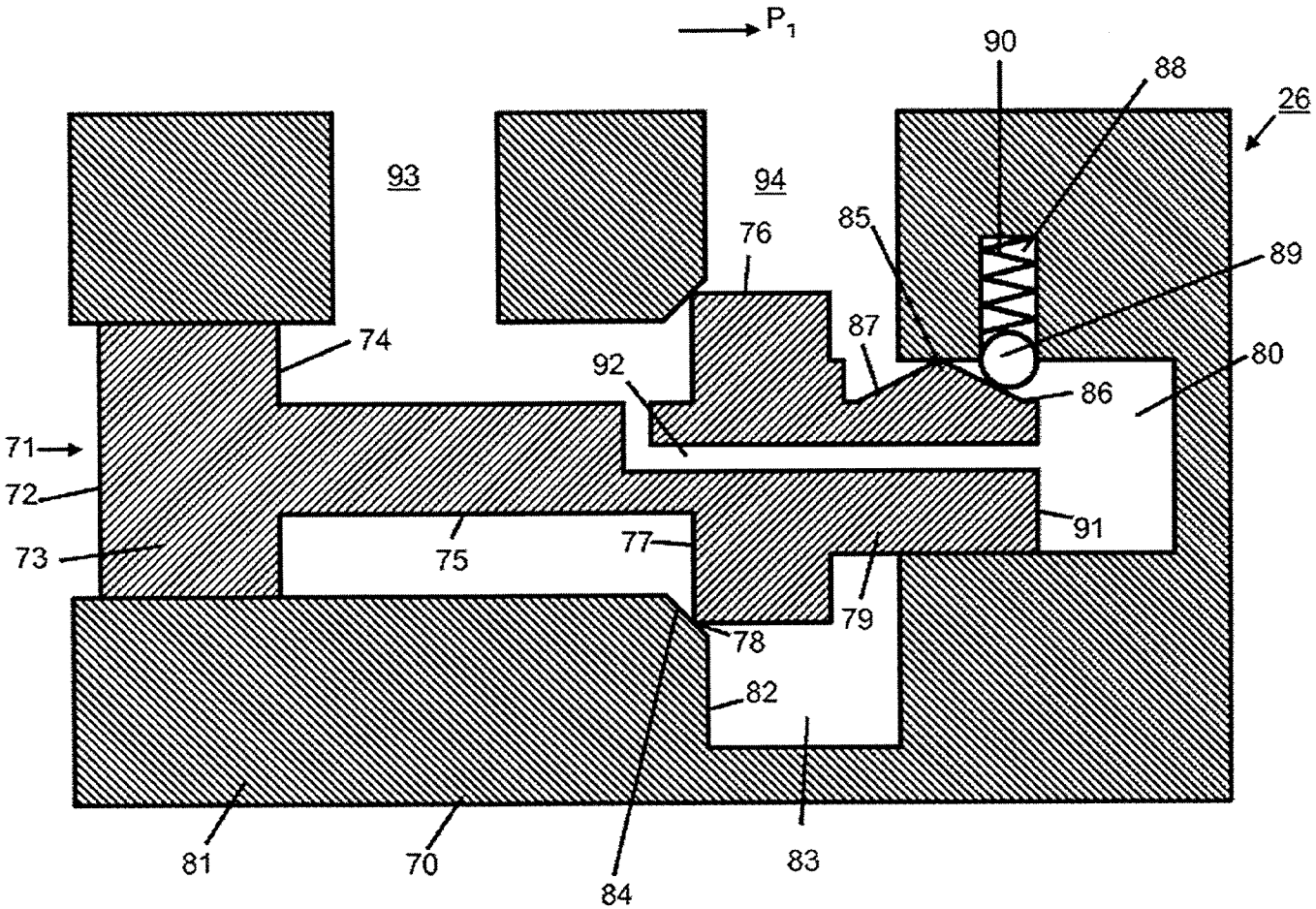
FIG. 3 shows a diagrammatic illustration of a first arrangement of the first main valve in accordance with an exemplary embodiment of the present disclosure.

FIG. 3 shows a diagrammatic illustration of a first arrangement of the first main valve in accordance with an exemplary embodiment of the present disclosure The first main control valve 26 according to FIG. 3 includes a cylinder body 70 in which a piston 71 is arranged movably. The piston 71 includes a free face 72 which has adjoining it a first piston section 73 which merges via a first radial step 74 into a second piston section 75 and which has a reduced diameter with respect to the first piston section 73. This second piston section 75 has adjoining it a third piston section 76, a second radial step 77 being provided between the second and the third piston section 75 and 76. The edge between the second step 77 and the third piston section 76 forms a sealing edge 78. The third piston section 76 has adjoining it a fourth piston section 79 which engages into a depression 80 in the cylinder body 70.

The outside diameter of the first piston section 73 is larger than the outside diameter of the second piston section 75. The third piston section 76 includes an outside diameter which is larger than the outside diameter of the first piston section 73, and the inside diameter of the depression 80 and in consequence the inside diameter of the fourth piston section 79 are smaller than the outside diameter of the first piston section 73. Inside the depression 80, the piston 71 is delimited by an inner end face 91.

The cylinder body 70 includes a first cylinder section 81, the inside diameter of which corresponds to the outside diameter of the first piston section 73 and which merges via a step 82 into a second cylinder section 83, there being formed at the transition point between the first cylinder section 81 and the step 82 a chamfer 84 which corresponds to the chamfer 63 and which together with the sealing edge 78 forms a seal.

Located on the outer face of the fourth piston section 79 is a radially projecting projection 85 which has two oblique faces 86 and 87 assigned to one another in the form of a roof. The depression 80 has issuing into it radially a blind hole bore 88 in which is guided a ball 89 which is pressed permanently against the oblique faces 86 or 87 by a spiral spring 90.

In the position which is shown in FIG. 3, the ball 89 presses against the oblique face 86 and thus prevents the piston 71 from being capable of moving into the depression 80 in the direction of the arrow P1 when no special forces are acting upon the piston 71. When the first main valve 26 is reversed by the pilot control valve 22, high pressure acts upon the first control face $F_1$/26 which corresponds to the free face 72, so that the piston 71 is displaced in the direction of the arrow P1, with the result that the ball 89 runs up on the oblique face 86 and is pressed into the interior of the blind hole bore 88. As soon as the ball 89 reaches the oblique face 87, with no further forces otherwise acting upon the piston 71, the ball 89 will retain the piston 71, the ball 89 being located between the oblique face 87 and the third piston section 76.

A duct 92 issues into the second piston section 75 and into the inner end face 91 and connects the space outside the second piston section 75 to the inner space of the depression 80. The same pressure consequently prevails at the step 77 and at the inner face 91.

The cylinder body 70 includes a first radial hole 93 and a second radial hole 94, the first hole 93 issuing into the region of the second piston section 75 and the hole 94 issuing into the second cylinder section 83. The position according to FIG. 3 is that position which the piston 71 assumes when low pressure prevails at the first control face $F_1$/26=free face 72. As soon as the first pilot control valve 22 is controlled in the passage direction and the second pilot control valve 35 is in the blocking position, the piston 71 is moved to the right on account of the high pressure prevailing at the face 72, with the result that the sealing point 78/84 is opened, so that high-pressure fluid can flow via the hole 94. The hole 94 then corresponds to the inlet port 25 and the hole 93 to the outlet port 27.

When the first pilot control valve 22 is reversed, high pressure prevails both on the face $F_1$/26 of the first main control valve 26 and on the face $F_1$/39 of the second main control valve 39. Since the pilot control valve 22 is opened only briefly, high pressure prevails at both first control faces $F_1$/26 and $F_1$/39. The second pilot control valve 35 is closed. If leakage then occurs at the second pilot control valve 35, the pressure between the two control faces $F_1$/26 and $F_1$/39 may then fall, so that undesirable switching actions of the two main control valves 26 and 39 may be caused. The orifice 33, which is located between the two control faces $F_1$/26 and $F_1$/39 and the space 17 above the piston, is intended to deliver pressure fluid to these two control faces $F_1$/26 and $F_1$/39, so that compensation can thereby take place.

In the case when the second pilot control valve 35 is opened briefly, low pressure prevails at the two first control faces $F_1$/26 and $F_1$/39. On account of leakage in the first pilot control valve 22, high pressure could pass into the line 23 and consequently arrive at the two first control faces $F_1$/26 and $F_1$/39, so that undesirable switching actions would be caused even as a result of this, if the orifice 33 were not to ensure compensation.

In other words:

the two steps, to be precise the pilot control valve step and the main control valve step, are connected to one another via the orifice 33, so that compensation leading to unwanted switching actions is achieved via the orifice 33.

Figure 4:
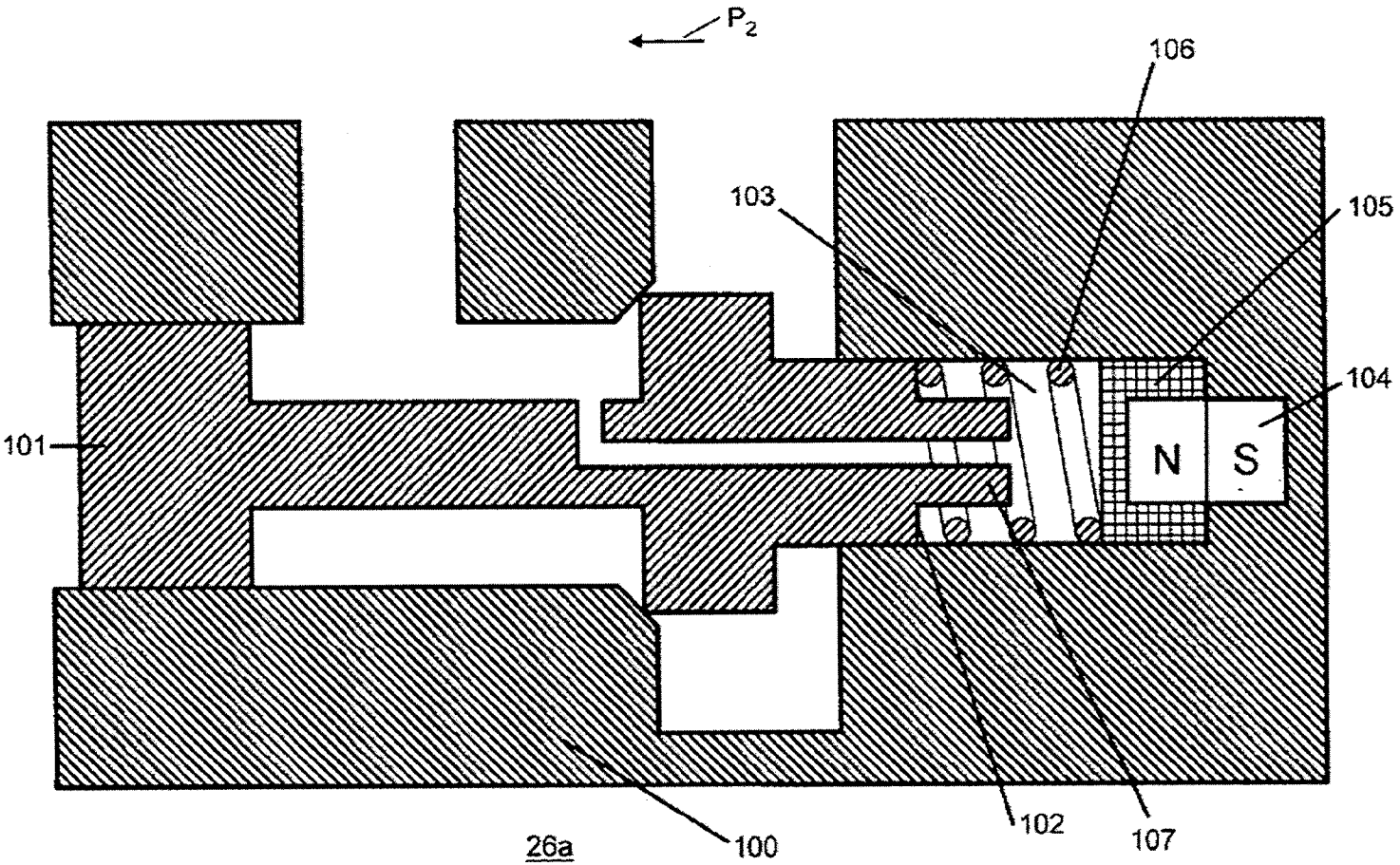
FIG. 4 shows a second arrangement of the first main valve in accordance with an exemplary embodiment of the present disclosure.

FIG. 4 shows a second arrangement of the first main valve in accordance with an exemplary embodiment of the present disclosure. In the exemplary embodiment shown in FIG. 4, the first main control valve is constructed in a similar way to the embodiment shown in FIG. 3, and it therefore receives the reference numeral 26*a* here. It includes a cylinder body 100 in which is guided a piston 101 which engages by means of an inner face 102 in a depression 103. Arranged on the bottom of the depression 103 is a permanent magnet 104 which is embedded into a non-magnetizable material part 105; arranged between the inner face 102 and the free face of the non-magnetizable material part 105 is a spiral spring 106 which seeks to press the piston 101 permanently in the direction of the arrow P2. Integrally formed on the inner face 102 is an axial extension 107 which, when the piston 101 is pressed into the interior of the depression 103 opposite to the direction of the arrow $P_2$ and the free face of the axial extension 107 comes to bear against the free face of the non-magnetizable material part 105, is permanently attracted by the permanent magnets 104 counter to the pressure of the spring 106. As soon as the piston 101 is pressed in the direction of the arrow $P_2$ on account of the hydraulic pressure forces, the force of the compression spring 106 predominates in the direction of the arrow $P_2$, as a result of which, overall, a stable valve is brought about. The main valve 26*a* is otherwise constructed identically to the main valve 26, but without the latching.

Figure 5:
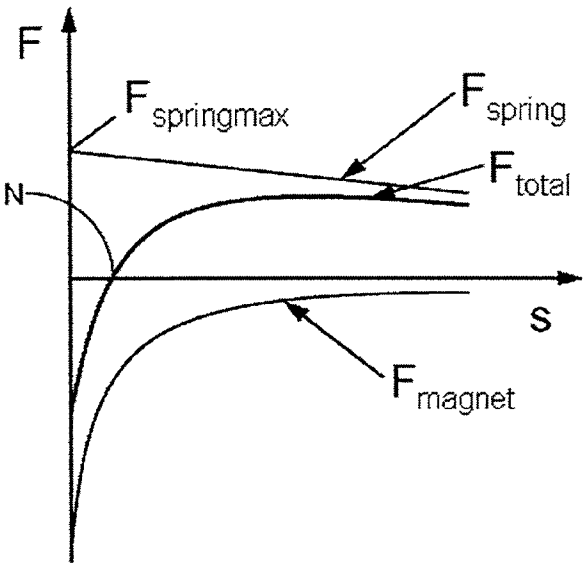
FIG. 5 shows a force/path graph of the second arrangement of the main valve according to FIG. 4.

FIG. 5 shows a force/path graph of the second arrangement of the main valve according to FIG. 4. FIG. 5 shows force conditions corresponding to the exemplary embodiment of FIG. 4. The force is plotted against the path S which the piston covers, the spring force decreasing linearly from its maximum value $F_{springmax}$ during the movement of the piston to the left in the direction $P_2$, whereas the magnetic force $F_{magnet}$ approaches zero non-linearly from a maximum value, when the piston 101 is in the position in which the spring force is at a maximum, when the piston 101 moves away from the permanent magnet 104. The resultant force $F_{total}$ includes a zero crossing N. On the left of the zero crossing, that is to say when the distance between the piston and the permanent magnet is small, the force of attraction of the permanent magnet predominates, and on the right of the zero crossing, when the magnetic force decreases, the force of the spring predominates, so that the resultant curve $F_{total}$ is formed.

It should be understood that both the cylinder body 100 and the movable piston 101 can be produced from ferromagnetic material, whereas the embedding mass 105 should be formed as a non-magnetizable material part.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Valve arrangement
11 Piston/cylinder arrangement
12 High-voltage circuit breaker
13 Cylinder
14 Piston
15 Piston rod
16 Movable contact piece
17 Space above the piston
18 Space below the piston
19 High-pressure reservoir
20 First line section, line length
21 Second line section, line length
22 First pilot control valve
23 Third line section
24 Fourth line section
25 Inlet port
26 First main control valve
**26*a*** First main control valve
27 Outlet port
28 Fifth line section
29 Junction point
30 First return
31 Second return
32 Second junction point
33 Orifice
34 Sixth line section
35 Second pilot control valve
36 Seventh line section
37 Low-pressure tank
38 Inlet port
39 Second main control valve
40 Outlet port
41 Eighth line section
42 First return
43 Second return
44 Electromagnetic system
45 Electromagnetic system
46 Restoring spring
47 Restoring spring
50 Cylinder body
51 Piston
52 Free face
53 Depression
54 Inner face
55 Inner duct
56 Sealing edge
57 First piston section
58 Step
59 Second piston section
60 Further step
61 Third piston section
62 First cylinder section
63 Chamfer
64 Spiral compression spring
70 Cylinder body
71 Piston
72 Free face
73 First piston section
74 First step
75 Second piston section
76 Third piston section
77 Second step
78 Sealing edge
79 Fourth piston section
80 Depression
81 First cylinder section
82 Step
83 Second cylinder section
84 Chamfer
85 Projection
87 Oblique face
88 Blind hole bore
89 Ball
90 Spiral spring
91 Inner face
92 Duct
93 First hole
94 Second hole
100 Cylinder body
101 Piston
102 Inner face
104 Permanent magnet
105 Material part
106 Spiral spring
107 Projection

What is claimed is:

1. A valve arrangement for actuating a piston of a piston/cylinder arrangement for a hydraulic or fluidic device, and for actuating the piston/cylinder arrangement for actuating of a movable contact piece of a high-voltage circuit breaker, comprising:

a main control valve arrangement including two 2/2-way valves as a first and a second main control valve which are activatable by a pilot control valve arrangement and provides a way for the fluid, which is under high pressure, to flow into a space above the piston and connects the space to a low-pressure tank for relieving pressure in the space, wherein the 2/2-way valves of each of the main and pilot control valve arrangements are separate from each other, wherein a second port of the first main control valve and a second port of the second main control valve are both connected at a first junction point to a third line section which issues into the space above the piston, wherein the 2/2-way valves of the main control valve arrangement are connected to a pilot control valve arrangement formed by two 2/2-way valves, such that the 2/2-way valves of the pilot control valve arrangement feed or deliver fluid to the main control valve arrangement at either a high pressure or a low pressure, wherein when the fluid, which is under high pressure, is supplied to the space above the piston, a first pilot control valve of the pilot control valve arrangement opens a path for the fluid which is under high pressure to flow into a main control face of the first main control valve, so that the first main control valve feeds the fluid which is at high pressure to the space above the piston and a second pilot control valve of the pilot control valve arrangement is closed, wherein when pressure is relieved in the space above the piston, the second pilot control valve opens a path from a main control face of the second main control valve to the low-pressure tank and the second main control valve opens a path from the space above the piston to the low-pressure tank, and wherein the high pressure fluid flows from the first pilot control valve to a main control face of the first main control valve.

2. The valve arrangement as claimed in claim 1, wherein an orifice having a small cross section is connected between the main control faces of the first and second main control valves and the space above the piston of the piston/cylinder arrangement.

3. The valve arrangement as claimed in claim 1, wherein a piston of the first main control valve, designed as a bistable valve, is retained in respective end positions.

4. The valve arrangement as claimed in claim 3, wherein the piston is retained mechanically by means of a spring-assisted ball latching.

5. The valve arrangement as claimed in claim 3, wherein the piston is retained in each end position either mechanically or magnetically.

6. The valve arrangement as claimed in claim 5, wherein the piston moves in a cylinder, a permanent magnet being provided at one end of the cylinder and a spring being provided between this end and the piston, and in that the force acting upon the piston has a zero crossing.

7. A valve arrangement for actuating a piston of a piston/cylinder arrangement for a hydraulic or fluidic device, comprising:

a main control valve arrangement including two 2/2-way valves as a first and a second main control valve, which are activatable by a pilot control valve arrangement and provides a way for the fluid, which is under high pressure, to flow into a space above the piston and connects the space to a low-pressure tank for relieving pressure in the space; and a pilot control valve arrangement having first and second pilot control valves that are 2/2 way valves and that are connected to the two 2/2 way valves, respectively, of the main control valve arrangement, wherein the 2/2-way valves of each of the main and pilot control valve arrangements are separate from each other, wherein a second port of the first main control valve and a second port of the second main control valve are both connected at a first junction point to a third line section which issues into the space above the piston, wherein when high pressure fluid is supplied to the space above the piston, the first pilot control valve opens a path for the high pressure fluid to flow into the first main control valve, so that the first main control valve feeds the high pressure fluid to the space above the piston, wherein when pressure is relieved in the space above the piston, the second pilot control valve opens a path from the second main control valve to the low-pressure tank and the second main control valve opens a path from the space above the piston to the low-pressure tank, and wherein the high pressure fluid flows from the first pilot control valve to a main control face of the first main control valve.

8. The valve arrangement as claimed in claim 7, wherein when the first main control valve feeds high pressure fluid to the space above the piston, the second pilot control valve of the pilot control valve arrangement is closed.

9. The valve arrangement as claimed in claim 7, wherein the second pilot control valve opens a path from a main control face of the second main control valve to the low-pressure tank.

10. The valve arrangement as claimed in claim 7, wherein an orifice having a small cross section is connected between the main control faces of the first and second main control valves and the space above the piston of the piston/cylinder arrangement.

11. The valve arrangement as claimed in claim 7, wherein a piston of the first main control valve, designed as a bistable valve, is retained in respective end positions.

12. The valve arrangement as claimed in claim 11, wherein the piston is retained mechanically by means of a spring-assisted ball latching.

13. The valve arrangement as claimed in claim 11, wherein the piston is retained in each end position either mechanically or magnetically.

14. The valve arrangement as claimed in claim 13, wherein the piston moves in a cylinder, a permanent magnet being provided at one end of the cylinder and a spring being provided between this end and the piston, and in that the force acting upon the piston has a zero crossing.

* * * * *